United States Patent [19]

Boorman, Jr. et al.

[11] 3,984,163

[45] Oct. 5, 1976

[54] CANTILEVER SLIDING SHELF INCLUDING A SHELF REMOVAL NOTCH ON ONE SIDE ONLY

[75] Inventors: Earl D. Boorman, Jr.; Donald H. Kolseth, both of Louisville, Ky.

[73] Assignee: General Electric Company, Louisville, Ky.

[22] Filed: Dec. 22, 1975

[21] Appl. No.: 643,487

[52] U.S. Cl. ..... 312/270; 312/296; 312/330 R; 312/350

[51] Int. Cl.[2] ..... A47B 96/00; A47B 88/04

[58] Field of Search ..... 312/116, 122, 270, 296, 312/297, 311, 330–336, 341, 346, 350; 211/153, 162; 108/143

[56] References Cited

UNITED STATES PATENTS

| | | | |
|---|---|---|---|
| 3,220,364 | 11/1965 | Sandin | 211/153 |
| 3,311,072 | 3/1967 | Pattison | 211/153 |
| 3,575,484 | 4/1971 | Kesling | 312/330 |
| 3,680,941 | 8/1972 | Shanks | 312/270 |
| 3,912,085 | 10/1975 | Cooke et al. | 211/153 |

*Primary Examiner*—Casmir A. Nunberg
*Attorney, Agent, or Firm*—Steven C. Schnedler; Francis H. Boos

[57] ABSTRACT

A shelf assembly particularly adapted for use in a household refrigerator comprises a cantilever supported frame and a sliding shelf which may easily be removed from the frame. The frame includes a pair of shelf guides or tracks which, in a preferred embodiment of the invention, are inwardly extending horizontal flanges attached to frame side members. The shelf includes a pair of shelf side members which are slidably supported on the cooperating upper surfaces of the horizontal flanges. Attached near the rear corners of the shelf are outwardly extending projections which ride against the lower surfaces of the flanges to prevent the rear of the shelf from moving upwardly. A stop prevents the shelf from being pulled out farther than the extended position. A notch is provided in one of the flanges so that the shelf may be removed from the frame by first aligning the notch and the corresponding projection and then tilting the shelf, but there is no corresponding notch in the other flange directly opposite the notch that is provided.

4 Claims, 5 Drawing Figures

CANTILEVER SLIDING SHELF INCLUDING A SHELF REMOVAL NOTCH ON ONE SIDE ONLY

BACKGROUND OF THE INVENTION

1. Field of the Invention

The present invention relates generally to a cantilever supported sliding shelf structure adapted for use in a refrigerator. More particularly, the invention relates to a shelf structure comprising a separate cantilever supported frame and a sliding shelf, the structure being constructed so that the shelf may be easily removed from the frame for cleaning but, in use, will not inadvertently become disengaged from the frame.

2. Description of the Prior Art

In a household refrigerator, it is desirable to provide vertically adjustable shelves so that the interior configuration of the refrigerator may be rearranged to accommodate different sizes of food at different times. It is also desirable that a refrigerator shelf be capable of sliding horizontally in and out to enable the user to more conveniently reach items on the back of the shelf. Further, it is desirable that such a shelf, particularly a glass shelf, can be easily removed for cleaning but will not inadvertently fall out at other times. For ease of handling, the weight of the part which must be removed for normal cleaning should be minimized through the use of a construction which permits the shelf portion to be separately removed, leaving the cantilever frame attached to its support. A separately removable shelf has the further advantage that the vertical adjustment of the shelf structure is not disturbed during removal of the separate shelf.

An example of a vertically adjustable cantilever slide-out shelf assembly for use in a refrigerator is disclosed in U.S. Pat. No. 3,311,072-Pattison. The Pattison patent discloses a wire shelf structure which provides the features of cantilever support, vertical adjustability, and horizontal slidability. Shelves such as the Pattison shelf are removed by sliding the shelf out until a shelf member contacts a stop projection on the frame. The front edge of the shelf is then lifted until the shelf member clears the stop. Another example of cantilever sliding shelf construction in which the shelf is removed by lifting the shelf to clear a stop is disclosed in U.S. Pat. No. 3,575,484-Kesling. Such shelves do not include the shelf removal means which embodiments of the present invention include, as is more fully described hereinafter.

A related structure is shown in U.S. Pat. No. 3,733,113-Glasford et al., which patent discloses a drawer assembly comprising a series of tracks supported in a frame and a removable drawer guided by each track. The tracks include channels which cooperate with pins on the sides of the drawers to generally keep the drawers on the tracks. Each channel is defined by upper and lower flanges. The pins on the sides of the drawers normally exert upward pressure on the lower surfaces of the upper flanges and are restrained from upward vertical movement thereby. The drawer bottoms ride on the upper surfaces of the lower flanges. In order to facilitate removal of the drawers, each upper flange includes at least one notched opening so that at a predetermined drawer position the drawer pins on both sides are aligned with the notched openings and the drawer can be removed by lifting the rear of the drawer. Such a design has the disadvantage that sufficient weight placed on the front of the drawer when the pins and openings are aligned can cause the rear to tip upward. Of course, placing the slots far enough back so that alignment occurs when the drawer is only pulled out a slight distance minimizes this problem by decreasing the leverage available to cause tilting. However, such an approach could cause manipulative difficulties due to the requirement that the drawer be substantially in the normal, recessed position when the rear is lifted for intentional removal purposes.

By the present invention, there is provided an improved cantilever-supported sliding shelf structure which includes novel means for removal of the shelf from the frame and which prevents inadvertent disengagement of the shelf from the frame due to weight being placed near the front of the shelf.

SUMMARY OF THE INVENTION

Accordingly, it is an object of the invention to provide a shelf structure including a sliding shelf which cannot inadvertently become disengaged from the frame due to weight being placed near the front of the shelf, but which can easily be intentionally removed.

It is another object of the invention to provide such a sliding shelf assembly which includes a removal notch and in which a predetermined shelf removal position may be any position along the path of the shelf between the normal and extended positions.

These and other objects are accomplished by the present invention which is an improvement to a sliding shelf structure of the type comprising a generally rectangular, vertically-adjustable, cantilever supported frame on which a separate generally rectangular sliding shelf is supported for horizontal movement between a normal position and an extended position. The frame includes a pair of frame side members adapted to be conventionally supported in cantilever fashion from a support at the rear of the shelf structure. Firmly attached to the frame side members are guides or tracks for the shelf. In a more general form of the invention, each guide or track includes a primary flange extending horizontally inwardly from the frame side member. Each of the primary flanges has at least a lower bearing surface. The shelf includes a pair of shelf side members which are slidably supported on cooperating shelf supporting surfaces associated with the frame side members. In a preferred embodiment of the invention, the above-mentioned shelf supporting surfaces are simply the upper surfaces of the primary flanges.

The shelf assembly also includes a pair of outwardly extending projections attached to the shelf near the rear corners thereof. The projections are adapted to ride against the lower bearing surfaces of the primary flanges, thereby preventing the rear of the sliding shelf from moving upwardly. Preferably, the outwardly extending projections are attached to depending legs which are, in turn, attached near the rear corners of the shelf. The shelf assembly further includes means for preventing horizontal movement of the sliding shelf beyond the extended position.

In accordance with the invention, a shelf removal notch which permits passage of a corresponding outwardly extending projection therethrough is provided in either one of the primary flanges, but no such notch is provided in the other of the primary flanges directly opposite the notch that is provided. The notch is positioned so that there is a predetermined position of the shelf, between the normal and extended positions, inclusive, at which the notch and the corresponding projection are in alignment. The shelf may therefore be easily removed from the frame by applying a gentle upward force on the one side of the shelf next to the notch while, at the same time, pulling the shelf forward slowly toward the extended position. When the predetermined position is reached, the one side of the shelf lifts up as the projection passes through the notch, permitting shelf removal. Reinstalling the shelf merely requires tilting the shelf so that the other projection slips under the other primary flange and then lowering one side so the one projection rests on the upper surface of the primary flange. The shelf is then pushed back and when the predetermined position is reached, the projection drops through the notch.

When a shelf assembly according to the present invention is in use, a weighted object on the shelf, even when placed near the front end thereof and even when the one projection is aligned with the notch, cannot cause the shelf to inadvertently become disengaged from the frame because upward movement is positively resisted by the cooperation of the horizontal flange not having a notch and the corresponding horizontal engagement portion. Even if the weight is placed at the apparent "worst case" position, near the corner of the shelf defined by the intersection of the front edge and the shelf side opposite the notch, the shelf will not tilt because there is no pivot between the point where downward force is applied and the notch.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
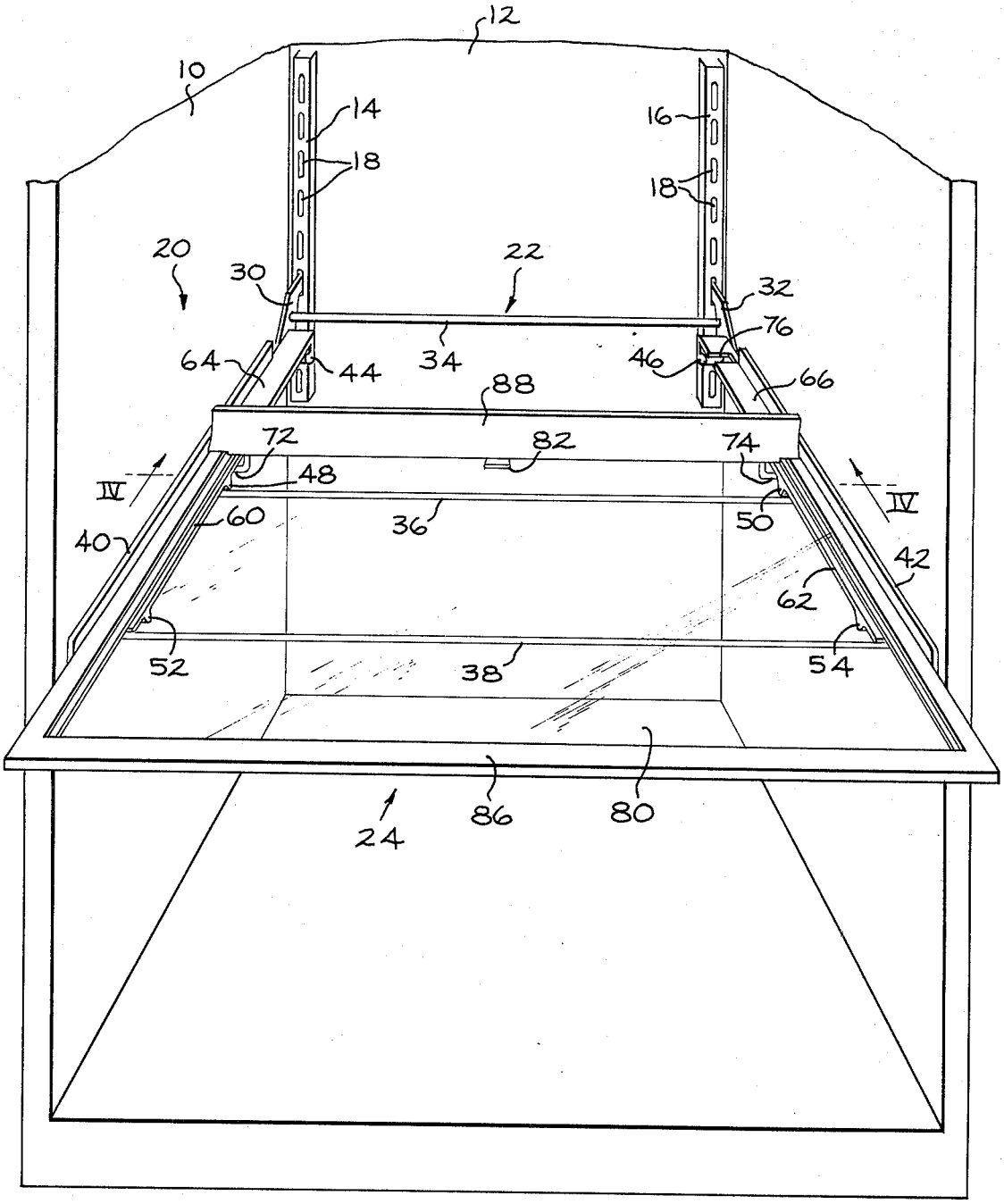
FIG. 1 is a front perspective view of a cantilever supported sliding shelf structure according to the present invention, with the shelf shown in its fully extended position.

Referring first to FIG. 1, there is shown a portion of a refrigerator cabinet looking in from the front, the front being open with the door not shown. The cabinet includes an inner liner 10 including a rear wall 12. Spaced from the vertical rear corners of the liner 10 and secured to the rear wall 12 are left and right vertically extending supports 14 and 16. Each of the supports 14 and 16 is of conventional U-shaped channel configuration with slots 18 cut into the front face. Additionally shown is a shelf structure 20 comprising a separate generally rectangular frame 22 and a generally rectangular shelf 24 supported on the frame 22.

Figure 3:
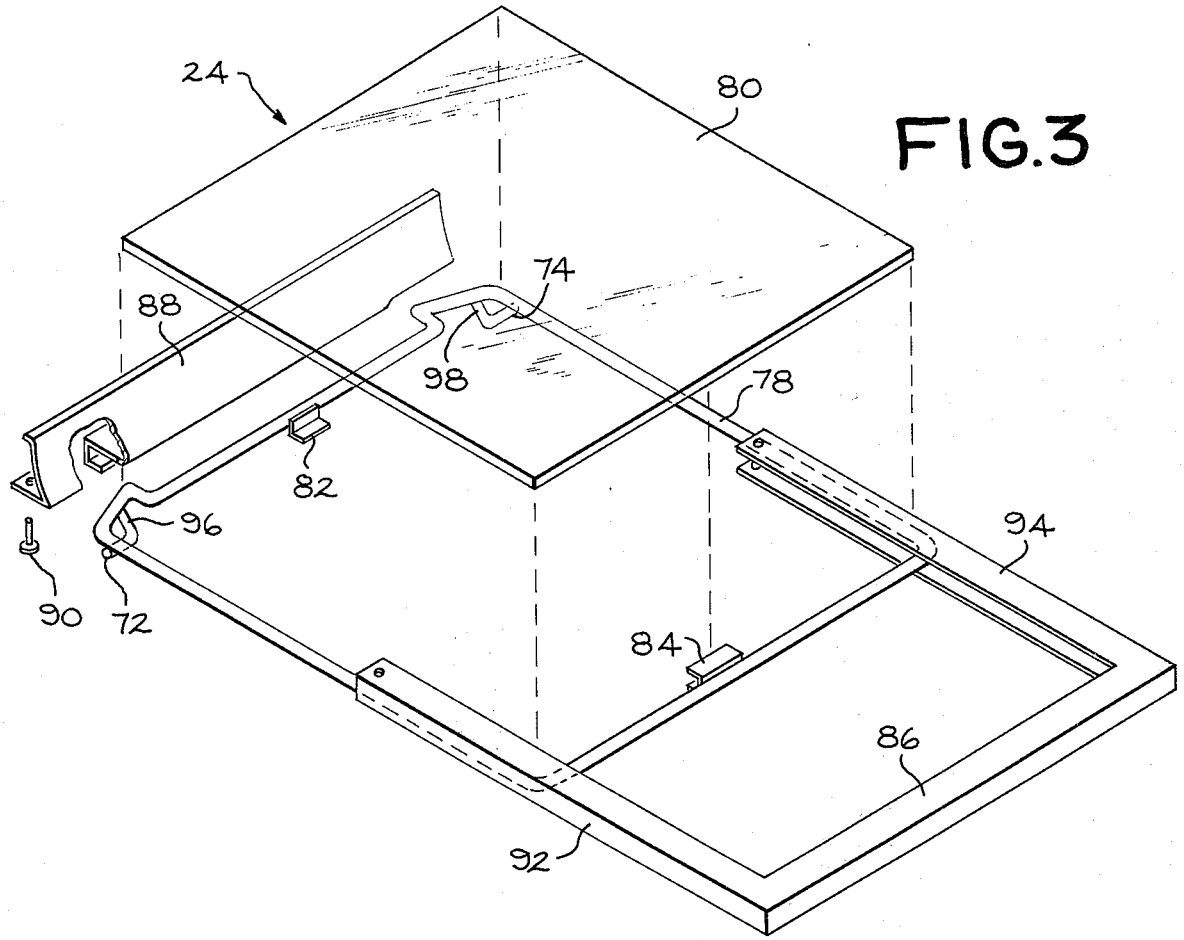
FIG. 3 is an exploded perspective view showing the removable shelf portion of the sliding shelf structure illustrated in FIG. 1, with a portion of the trim member cut away.
Figure 2:
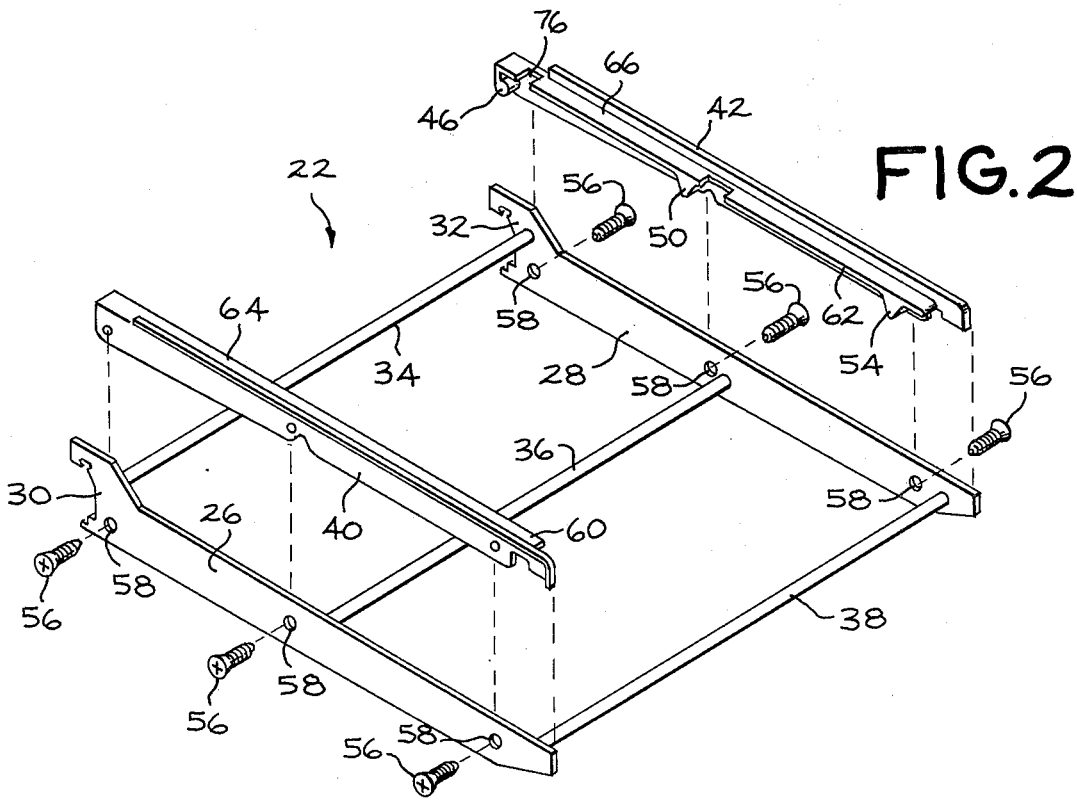
FIG. 2 is an exploded perspective view showing the cantilever frame portion of the sliding shelf structure illustrated in FIG. 1, with a portion of the right side track member cut away for clarity of illustration.
Figure 4:
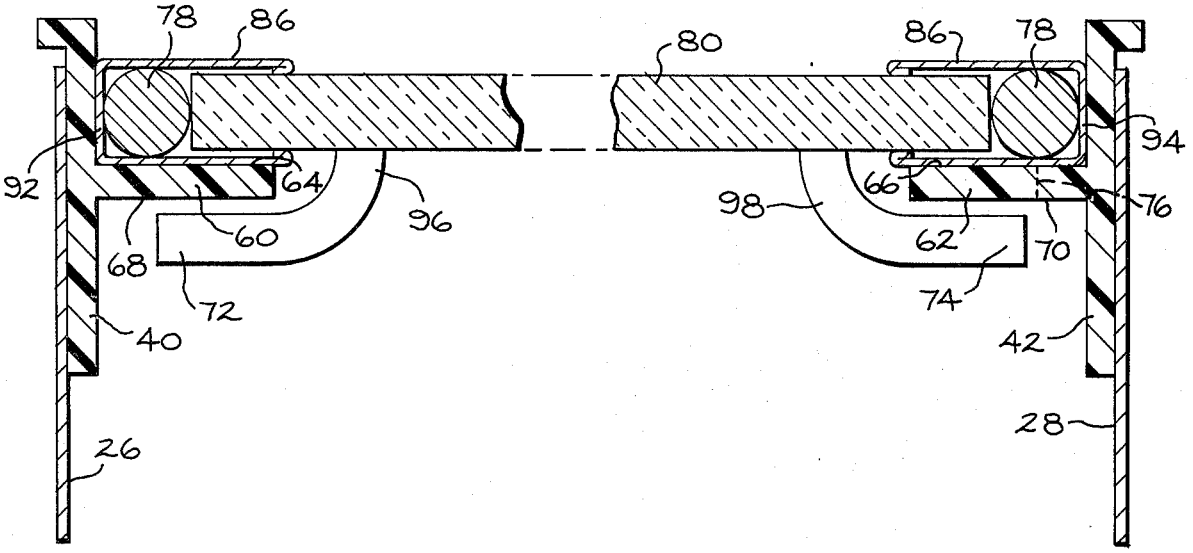
FIG. 4 is a sectional view taken along the line IV—IV of FIG. 1.

Referring now, in addition to FIG. 1, to FIGS. 2, 3, and 4, constructional details of the shelf structure 20 are illustrated. It will be understood that FIGS. 2 and 3 are exploded views for a clearer illustration of the various component parts, FIG. 2 being an exploded view of the frame 22 and FIG. 3 being an exploded view of the shelf 24.

The frame 22 includes a pair of opposed, longitudinally extending metal frame side members 26 and 28 having ends 30 and 32 adapted for engagement with the slots 18 of the left and right supports 14 and 16 for cantilever support therefrom. The frame side members 26 and 28 are interconnected by cross bars 34, 36 and 38 to provide rigidity for the frame 22, the ends of the cross bars 34, 36 and 38 being welded to the frame side members 26 and 28.

Attached to the frame side members 26 and 28 are track members 40 and 42, preferably formed of plastic or nylon. The track members 40 and 42 include screw bosses 44, 46, 48, 50, 52, and 54 to receive screws 56 which pass through apertures 58 in the frame side members 26 and 28 to hold the track members 40 and 42 securely thereto.

The track members 40 and 42 further include inwardly extending horizontal flanges 60 and 62, which are hereinafter referred to as primary flanges 60 and 62. (While the embodiment illustrated in FIGS. 1 through 4 has only the primary flanges 60 and 62 and has no secondary flanges, the primary flanges 60 and 62 are described as such to allow convenient comparison to additional flanges included in an alternative embodiment which is described below with reference to FIG. 5.)

The primary flanges 60 and 62 have upper shelf supporting surfaces 64 and 66 and lower bearing surfaces 68 and 70 (best seen in FIG. 4) which cooperate with outwardly extending projections 72 and 74 attached near the rear corners of the shelf 24 to prevent the rear of the shelf 24 from moving upward. The projections 72 and 74 additionally cooperate with the middle screw bosses 48 and 50 (best seen in FIG. 1) to prevent horizontal movement of the shelf 24 forward beyond the extended position.

It will be apparent, particularly with reference to the embodiment shown in FIG. 5, hereinafter described, that the shelf supporting surfaces 64 and 66 could be the upper surfaces of secondary flanges, and need not be the upper surfaces 64 and 66 of the primary flanges 60 and 62. It will also be apparent that, rather than depending upon cooperation of the horizontal projections 72 and 74 with the middle screw bosses 48 and 50 to prevent horizontal movement of the shelf 24 beyond the extended position, any conventional means for limiting forward movement of the shelf 24 may be employed.

In accordance with the present invention, a shelf removal notch 76 is included in one of the primary flanges, but there is no corresponding notch in the other of the primary flanges positioned directly opposite the notch in the one flange. In the embodiment shown in FIGS. 1 through 4, the notch 76 is cut into the right-hand flange 62 and there is no notch directly opposite the notch 76 in the left-hand flange 60. It will be apparent that the notch 76 could be cut in either flange 60 and 62 provided there was no notch on directly opposite the other flange. It will further be apparent that more than one notch could be cut in each flange and notches could be cut on both flanges without departing from the scope of the invention, provided the notches were not directly opposite one another.

Referring particularly to FIG. 3, as well as to FIG. 1, details of the construction of the shelf 24 are shown. The shelf 24 comprises a generally rectangular wire member 78 and a sheet of glass 80. Attached to the rear of the wire member 78 is an L-shaped bracket 82 and attached to the front of the wire member 78 is a U-shaped bracket 84, the L-shaped bracket 82 and the U-shaped bracket 84 serving to hold the glass 80 in the proper position within the wire member 78, particularly during assembly of the shelf 24. The shelf 24 also includes a U-shaped channel member 86 extending around three sides of the wire member 78 and a decorative reflector trim member 88 extending along the fourth side or rear of the wire member 78. The members 86 and 88 are held together by means such as the rivet 90 and together serve to conceal the wire member 78 and to hold the glass 80 securely in place. The left and right sides 92 and 94 of the U-shaped channel member 86 serve as shelf side members for transmitting the weight of the shelf 24 to the shelf supporting surfaces 64 and 66.

The shelf 24 further includes depending legs 96 and 98 attached near the rear corners thereof. The depending legs 96 and 98 include the above-mentioned outwardly extending projections 72 and 74 which are adapted to ride against the cooperating lower bearing surfaces 68 and 70 (FIG. 4) to prevent the rear of the shelf 24 from moving upward. While the depending legs 96 and 98 are shown attached at the rear corners of the wire member 78, it will be apparent that the depending legs 96 and 98 could be attached near the rear corner, but farther up along the sides, with the limitation that the farther away from the rear corners the projections 72 and 74 are placed, the less the shelf 24 will be able to extend outwardly.

While the shelf 24 is shown as a glass shelf in FIG. 3, it will be apparent that numerous variations thereof are possible. For example, as is shown in FIG 5, hereinafter described in greater detail, a wire shelf may be used. Another alternative is the shelf construction disclosed in U.S. Pat. No. 3,912,085-Cooke et al., in which a glass sheet is held within a wire member by frictional forces between cooperating elements without the use of screws or rivets.

Shelf 24 is assembled to the frame 22 by placing the shelf 24 over the frame 22 approximately three-quarters of the way back and tilting the shelf to the left at an angle of approximately 30°. The left-hand projection 72 is then inserted under the flange 60 in contact with the lower bearing surface 68. The right-hand side of the shelf 24 is then lowered so that the right-hand projection 74 rests upon the shelf supporting surface 66. The shelf 24 is then pushed rearwardly until the projection 74 falls through the notch 76.

To remove the shelf 24 from the frame 22, upward pressure is applied to the right-hand side of the shelf 24 while the shelf 24 is pulled slowly forward toward the extended position. When a predetermined position, at which the projection 74 is in alignment with the notch 76, is reached, the projection 74 passes through the notch 76 and the shelf 24 is then easily removed.

In operation, a weighted object placed on the shelf 24, even when placed near the front end thereof, cannot cause the rear of the shelf 24 to move upwardly. Because there is no notch cut in the flange 60 directly opposite the notch 76, upward movement of the rear of the shelf must be accompanied by tilting of the shelf 24. There is no point on the shelf 24 at which downward weight can cause the shelf to tilt. Tilting can only be caused by manually lifting the right-hand side. Therefore, the shelf cannot inadvertently become disengaged from the frame 22 during use.

As mentioned above, a notch could be cut into the left side flange 60 without departing from the scope of the invention, so long as the notch cut in the left side flange 60 is not exactly opposite the notch 76 in the right side flange 62. A tilting of the shelf 24 would still be required for removal.

Further, when in accordance with the present invention, the notch 76 is cut in only one of the primary flanges 60 and 62, the notch 76 need not be near the rear of the shelf structure 20, but rather may be anywhere along the flange such that the predetermined position at which the projection 74 and the notch 76 are in alignment occurs somewhere along the path of the shelf 24 between the normal position, when the shelf 24 is all the way back, and the fully extended position, inclusive. The notch 76, therefore, may be located where most convenient for easy removal and replacement of the shelf 24.

As best seen from FIG. 1, the horizontal projections 72 and 74 cooperate with the middle screw bosses 48 and 50 to prevent horizontal movement of the shelf 24 beyond the extended position. However, any such means for limiting forward movement of the shelf 24 beyond the extended position may be employed.

Figure 5:
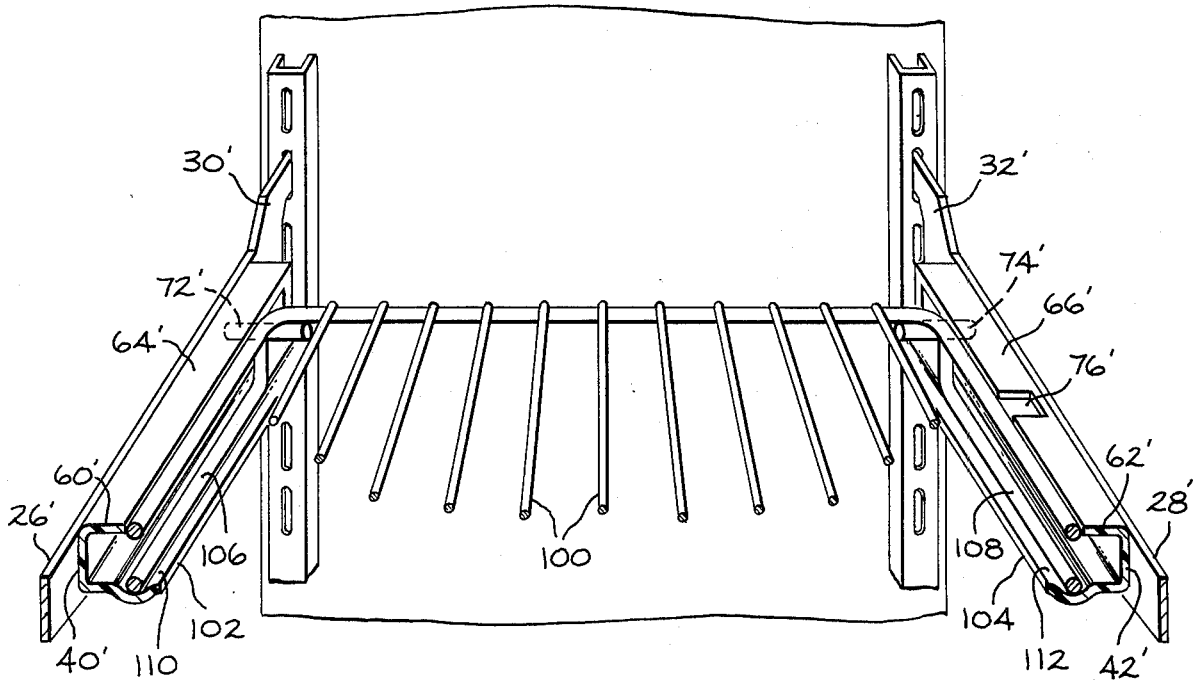
FIG. 5 is a fragmentary perspective view similar to FIG. 1 showing an alternative embodiment of the invention.

Referring now to FIG. 5, there is shown an alternative embodiment of the invention. In FIG. 5, a number of elements, designated by primed reference numerals, are substantially identical to elements of the previously described embodiment, so a detailed description thereof will not be repeated. The alternative embodiment shown in FIG. 5 differs from the embodiment illustrrated in FIGS. 1 through 4 in that a wire shelf, rather than a glass shelf, is shown and the upper surfaces 64' and 66' of the primary flanges 60' and 62' are not used to support the shelf 24'. The shelf 24' includes a plurality of longitudinally extending wires 100 welded to the wire member 78' in place of the glass 80. The track members 40' and 42', in addition to the primary flanges 60' and 62' include secondary flanges 102 and 104 for supporting the shelf 24'. The secondary flanges 102 and 104 are located below the primary flanges 60' and 62'. As stated above, the upper surfaces 64' and 66' of the primary flanges 60' and 62' are not used to support the shelf 24'. The shelf 24' includes shelf side members 106 and 108 for transmitting the weight of the shelf 24' to upper shelf supporting surfaces 110 and 112 of the secondary flanges 102 and 104. In FIG. 5, it can be seen that the primary flanges 60' and 62' do not extend as far inward as do the secondary flanges 102 and 104, so that the shelf 24 clears the primary flanges 60' and 62' when it is removed.

It will readily be appreciated that the essential elements and the operation of the embodiment shown in FIG. 5 are the same as those of the embodiment shown in FIGS. 1 through 4.

The present invention, therefore, provides a cantilever sliding shelf structure, including a shelf which cannot inadvertently become disengaged from the frame due to weight placed near the front of the shelf but which can easily be intentionally removed.

While specific embodiments of the invention have been illustrated and described herein, it is realized that modifications and changes will occur to those skilled in the art. It is, therefore, to be understood that the appended claims are intended to cover all such modifications and changes as fall within the true spirit and scope of the invention.

What is claimed is:

1. A refrigerator sliding shelf structure comprising:

a. a supporting frame having a pair of frame side members, each of said frame side members including a shelf supporting surface and an inwardly extending primary flange having at least a lower bearing surface;

b. a shelf slidably supported on said shelf supporting surfaces for horizontal movement between a normal and an extended position, said shelf including a pair of outwardly extending projections attached near the rear corners of said shelf, said projections being adapted to ride against said lower bearing surfaces to prevent the rear of said sliding shelf from moving upwardly;

c. means for preventing horrizontal movement of said shelf beyond the extended position; and d. a notch in one of said primary flanges to permit vertical passage of a corresponding one of said projections through said notch, said notch being positioned so that said corresponding one of said projections aligns with said notch when said shelf is at a predetermined position between the normal and extended positions, inclusive, there being no corresponding notch in the other of said primary flanges directly opposite said notch.

2. A shelf structure according to claim 1, wherein said frame side members are adapted to be supported in cantilever fashion from a support at the rear of the shelf structure.

3. A shelf structure according to claim 1, wherein a. said shelf supporting surfaces are positioned above said lower bearing surfaces; and b. said shelf further comprises a pair of depending legs attached near the rear corners of said shelf and each of said outwardly extending projections is attached to the lower part of one of said depending legs.

4. A shelf structure according to claim 3, wherein said shelf supporting surfaces are the upper surfaces of said primary flanges.

* * * * *